US008252156B2

(12) United States Patent
Dumont et al.

(10) Patent No.: US 8,252,156 B2
(45) Date of Patent: Aug. 28, 2012

(54) ELECTRODE CONTAINERS AND ASSOCIATED METHODS

(75) Inventors: Charles Dumont, Chicoutimi (CA); Giovanni Pucella, Chicoutimi (CA)

(73) Assignee: Alcoa Inc., Pittsburgh, PA (US)

( * ) Notice: Subject to any disclaimer, the term of this patent is extended or adjusted under 35 U.S.C. 154(b) by 1015 days.

(21) Appl. No.: 11/870,818

(22) Filed: Oct. 11, 2007

(65) Prior Publication Data

US 2008/0097135 A1 Apr. 24, 2008

Related U.S. Application Data

(60) Provisional application No. 60/862,041, filed on Oct. 18, 2006.

(51) Int. Cl.
*C25C 7/00* (2006.01)
*C25C 3/08* (2006.01)
*C25C 3/22* (2006.01)

(52) U.S. Cl. ..... 204/279; 204/243.1; 205/389; 49/366; 49/368

(58) Field of Classification Search ..... None
See application file for complete search history.

(56) References Cited

U.S. PATENT DOCUMENTS

| | | | | |
|---|---|---|---|---|
| 2,666,962 | A * | 1/1954 | Tripp | 49/34 |
| 2,757,787 | A * | 8/1956 | Sergent | 206/361 |
| 3,848,861 | A * | 11/1974 | Rumping | 266/199 |
| 3,919,071 | A * | 11/1975 | Mose | 204/279 |
| 4,072,595 | A * | 2/1978 | Chambers et al. | 204/219 |
| 4,397,728 | A | 8/1983 | Pfister et al. | 204/243 |
| 4,406,713 | A * | 9/1983 | Yutori et al. | 148/654 |
| 4,406,767 | A | 9/1983 | Fischer | 204/247 |
| 5,836,322 | A * | 11/1998 | Borger et al. | 134/42 |
| 5,961,812 | A * | 10/1999 | Bouzat et al. | 205/391 |
| 6,161,307 | A | 12/2000 | Bourgeois et al. | 34/362 |
| 6,200,438 | B1 * | 3/2001 | Clasen et al. | 204/279 |
| 7,678,244 | B2 * | 3/2010 | Despinasse et al. | 204/242 |
| 2004/0107488 | A1 * | 6/2004 | Brown et al. | 4/255.01 |
| 2005/0194249 | A1 * | 9/2005 | Despinasse et al. | 204/297.01 |

FOREIGN PATENT DOCUMENTS

| | | |
|---|---|---|
| DE | 4221882 | 1/1994 |
| WO | WO 03/042618 | 5/2003 |

OTHER PUBLICATIONS

English abstract of DE 4221882 A1, Jan. 1994.*
International Search Report and Written Opinion from corresponding International Application No. PCT/US2007/081069.

* cited by examiner

*Primary Examiner* — Harry D Wilkins, III
(74) *Attorney, Agent, or Firm* — Greenberg Traurig, LLP

(57) ABSTRACT

Electrode containers and associated methods are provided. In one embodiment, an electrode container includes sides and a top, and the top includes an opening adapted to receive a rod of an electrode. A plurality of flexible members are interconnected about the perimeter of the opening, wherein at least some of the plurality of flexible members overlap with one another. In one embodiment, a method includes removing an electrode from a metal electrolysis cell and placing the electrode into a container, where the placing step includes the steps of engaging at least one lever of a top flap of the container with a surface of the electrode and, concomitant to the engaging step, moving the top flap from a first position to a second position.

19 Claims, 9 Drawing Sheets

ELECTRODE CONTAINERS AND ASSOCIATED METHODS

CROSS-REFERENCE TO RELATED APPLICATION

This patent application claims priority to U.S. Provisional Patent Application No. 60/862,041, entitled "COVERS FOR SPENT ANODES AND SEALING APPARATUS THEREOF", filed Oct. 18, 2006, which is incorporated herein by reference.

BACKGROUND

Metal electrolysis cells, such as aluminum electrolysis cells, may employ a plurality of anodes immersed in a metal salt bath. At the end of their life cycle, the used (spent) anodes must be removed from pots and replaced with new anodes. During the removal process, a crust may envelop the used anode. This crust may include substances that may undesirably vaporize into ambient air. In the case of aluminum electrolysis cells, ambient air may combine with fluorine of the crust to produce HF gases, which are particularly undesirable.

SUMMARY OF THE INVENTION

Broadly, the instant disclosure relates to containers for holding electrodes (e.g., spend anodes of an aluminum electrolysis cell) and methods of containing gaseous emissions from the electrodes. In one aspect, an apparatus is provided. In one approach, the apparatus includes a spent anode container having sides and a top, the top including an opening adapted to receive an anode rod of a spent anode, and a plurality of flexible members interconnected about the perimeter of the opening, wherein at least some of the plurality of flexible members overlap with one another. The flexible members may be adapted to restrictively engage one or more outer surfaces of a rod of an electrode (e.g., an anode rod) so as to restrict gaseous emissions of the electrode exiting the container. In one embodiment, the flexible members may surround the rod of the electrode, so as to restrict gaseous emissions from exiting the container via space surrounding/proximal to the rod.

The flexible members may be corrosion and heat resistant. In one embodiment, the at least some of the flexible members are made of a flexible steel. In one embodiment, at least some of the flexible members have a width sufficient to resist breaking from physical engagement with the electrode rod. In one embodiment, the plurality of flexible members have a width sufficient to facilitate flexing while physically engaged with the anode rod. In one embodiment, the plurality of flexible members comprise a width of from about 0.75 inches to about 1.25 inches. In one embodiment, the opening is round and has a diameter of between about 20 inches and 28 inches, and the plurality of flexible members have a length of from about 10 to about 14 inches.

The flexible members may be suitably arranged to restrict gaseous emissions while facilitating non-destructive engagement with the electrode rod. In one embodiment, a single layer of flexible members are positioned about the opening. In another embodiment, a plurality of layers of flexible members are positioned about the opening. In one embodiment, the plurality of flexible members includes a first layer of members and a second layer of members, where the first layer of members has a first length and the second layer of members has a second length. In one embodiment, the first length is shorter than the second length. In one embodiment, at least some of the members of the first layer have a first thickness and at least some of the members of the second layer have a second thickness. In one embodiment, this first thickness is greater than the second thickness. In one embodiment, the first layer of members is located above the second layer of members. In another embodiment, the second layer of members is located above the first layer of members. In one embodiment, the plurality of members further includes a third layer of members having a third length, wherein the third layer of members is located below the second layer of members, and wherein the third length is shorter than the second length. In one embodiment, the third length is approximately the same length as the first length.

The top and sides of the container may be integral or may be separate. Furthermore, the container may include features to facilitate entry of the electrode into and exit of the electrode out of the container. In one embodiment, the top includes a first flap and a second flap, and the sides include a first side and a second side. In one embodiment, the first flap is interconnected to a first side via a hinge, and the second flap is connected to a second side via a hinge. In one embodiment, the first flap includes a first set of flexible members, and the second flap includes a second set of flexible members. In one embodiment, when the top is in a closed position, the first set of members and second set of members define the opening that receives the anode rod of the spent anode. In one embodiment, the container includes a first lever connected to the first flap and a second lever connected to the second flap. In one embodiment, the first and second levers are adapted to engage a portion of the spent anode as the spent anode is inserted into the container to facilitate movement of the first and second flaps from an open position to a closed position. In one embodiment, distal ends of the first and second levers extend toward a center axis of the container when the first and second flaps are in an open position. In a related embodiment, distal ends of the first and second levers extend toward the bottom of the container when the first and second flaps are in a closed position.

In another aspect, methods are also provided. In one approach, a method includes the steps of removing a spent anode from an electrolysis cell and placing the spent anode into a container, where the placing step includes engaging at least one lever of a top flap of the container with a surface of the spent anode, and concomitant to the engaging step, moving the top flap from a first position to a second position. In one embodiment, the method includes the step of moving, in response to the placing step, the top flap of the container from an open position to a closed position. In one embodiment, when the top flap is in a closed position, at least some of the flexible members of the top flap engage an outer surface of an anode rod of the spent anode. In one embodiment, the method includes removing the spent anode from the container and, concomitant to the removing step, moving the top flap from the closed position to the open position. In one embodiment, the moving the top flap from the closed position to the open position step includes engaging a surface of the top flap with a surface of the spent anode.

As may be appreciated, various ones of the inventive aspects noted hereinabove may be combined to yield various containers. The containers may restrict fluid emissions of an electrode (e.g., a spent anode of an electrolysis cell). These and other aspects, advantages, and novel features of the invention are set forth in part in the description that follows and will become apparent to those skilled in the art upon examination of the following description and figures, or may be learned by practicing the invention.

DETAILED DESCRIPTION

Figure 1:
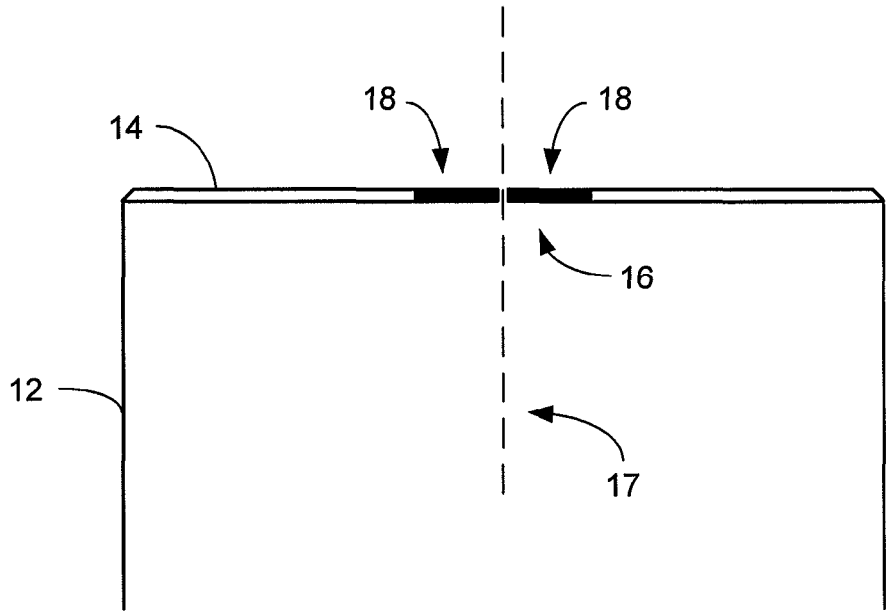
FIG. 1 is a cross-sectional schematic view of one embodiment of a spent anode cover.
Figure 2:
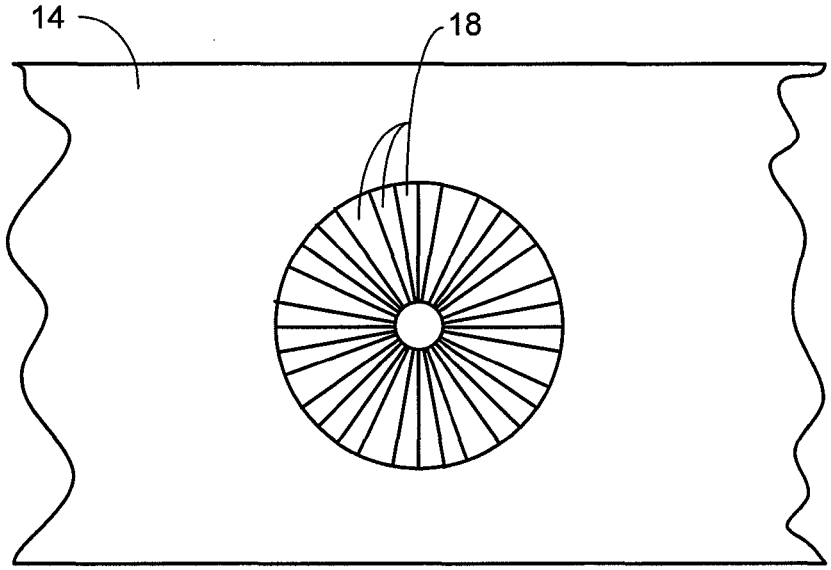
FIG. 2 is a top perspective view of the anode cover of the container of FIG. 1.
Figure 3:
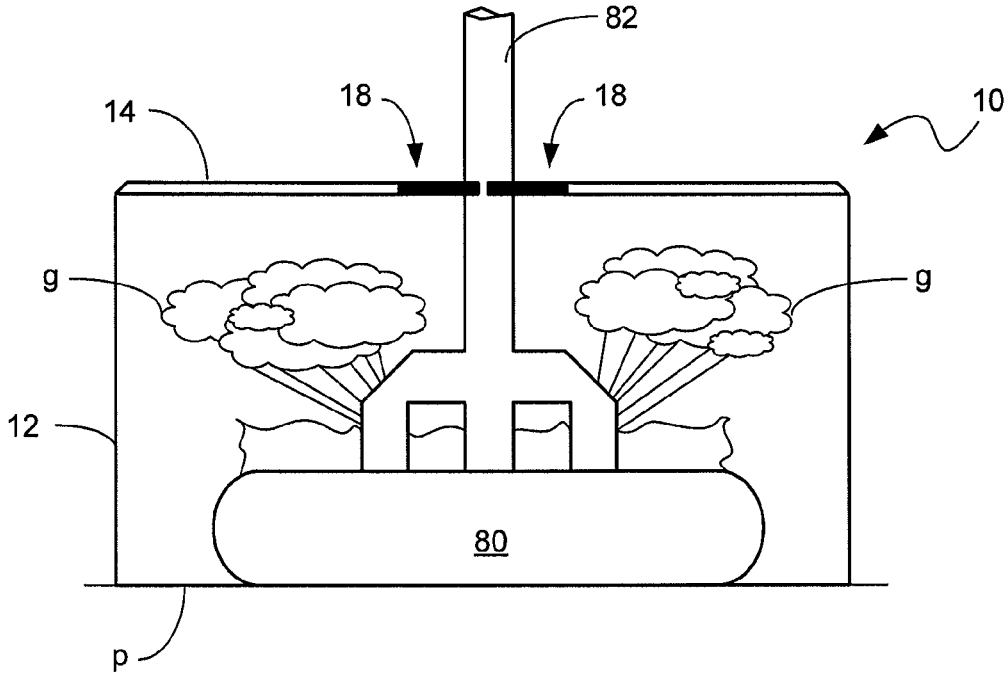
FIG. 3 is a cross-sectional view of the container of FIG. 1 with a spent anode included therein.

Reference is now made to the attached drawings, which at least assist in illustrating various pertinent features of the instant disclosure. One embodiment of an electrode container (sometimes referred to herein as a spent anode cover) is illustrated in FIGS. 1-3. The electrode container 10 includes sides 12 and a top 14 defining an enclosure, the enclosure being adapted to mate with a platform having spent anodes disposed thereon. The top 14 includes at least one opening 16 for receiving the rod of an electrode (e.g., an anode or cathode, such as a spent anode). In the illustrated embodiment, the sides 12 and top 14 are integral (e.g., a single body). However, the top 14 and sides 12 could be made in two separate parts. For example, in other embodiments, described below, the top 14 is connected to the sides 12 via hinges so as to facilitate insertion of and removal of spent anodes into and out of the cover 10.

A plurality of flexible members 18 are interconnected about the perimeter of the opening 16 and extend therefrom toward the center axis 17 of the opening 16. At least some of the flexible members 18 are oriented so that they overlap with at least one other flexible member. In most instances, a majority of the flexible members 18 will overlap with at least one other flexible member, and in some instances all of the flexible members 18 will overlap with at least one other flexible member (e.g., as in FIG. 2). This overlapping technique facilitates flexing of the flexible members 18 during entry and exit of an anode rod and further restricts gas emissions from exiting the cover 10 via the opening 16.

For example, and with reference to FIG. 3, the cover 10 may be placed on top of a platform P having a spent anode 80 disposed thereon. During placement of the cover 10, the anode rod 82 of the spent anode 80 will enter the opening 16, and the flexible members 18 will flex and restrictively engage the anode rod 82 as the cover 10 is moved toward the platform P. Thereafter, gases (g) emitted from the spent anode 80 will be restricted from exiting the opening 16 of the cover 10 via the flexible members 18.

The opening 16 may be any shape. To restrict breakage of the flexible members 18, often the opening will be of a round or ellipsoidal shape, such as a cylindrical shape. The opening 16 should also have a diameter that facilitates entry and exit of the anode rod 82 via the flexible members. For spent anodes of a conventional aluminum electrolysis cell, the opening 16 generally is of a cylindrical shape and has a diameter of from about 20 inches to about 28 inches, such as a diameter of about 24 inches. Such diameters have been found to accommodate conventional spent anodes of irregular shape and size while facilitating engagement of the anode rod 82 by the flexible members 18.

Figure 4:
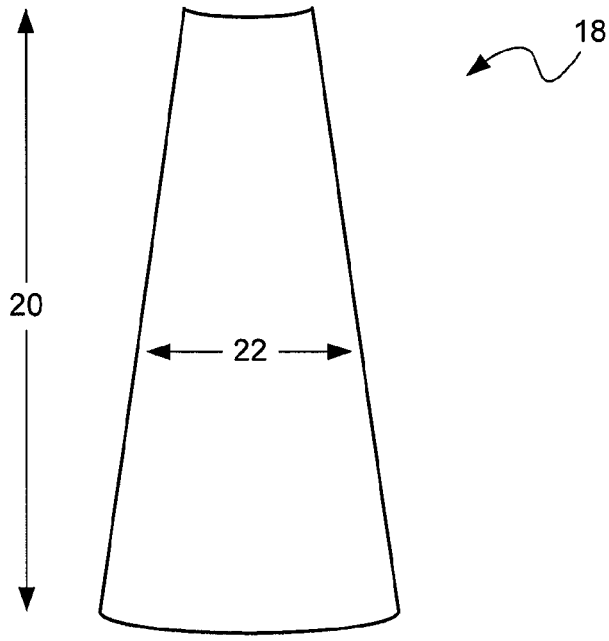
FIG. 4 is top perspective view of one embodiment of a flexible member.

Referring now to FIG. 4, each flexible member 18 generally has a length 20 that is slightly less than or equal to the radius of the opening 16. Each of the flexible members 18 also have an average width 22 sufficient to withstand the force applied to each flexible member 18 via engagement of the anode rod 82. Each of the flexible members 18 are also thick enough to withstand the force applied to each flexible member 18 while the flexible members are engaged with the anode rod 82. The flexible members 18 may be of any suitable shape, such as of a polyhedron having at least one trapezoidal face, as illustrated in FIG. 4, or a prism or a rectangular solid shape.

The flexible members 18 are generally made of a material that (i) can withstand the heat from the anode rod 82 during entry (e.g., about 200° C.-500° C.), (ii) is suitably inert to the gases produced from the spent anode, and (iii) is flexible. In one embodiment, at least one flexible member 18 comprises a tempered metal material. In another embodiment, at least one flexible member 18 comprises a flexible steel. In a particular embodiment, the steel is a blued steel. Steel is non-consumable relative to conventional sealing material (e.g., silicone or high temperature fabrics) and may be recyclable, thereby decreasing capital costs associated with the spent anode covers. Furthermore, flexible members 18 comprising steel are substantially inert to hydrogen fluoride (HF) and other fluoride-containing gases and are relatively durable. Indeed, spent anode covers employing steel flexible members may have a lifetime of at least about 3 months, such as a lifetime of at least about 6 months, or even at least about 12 months. For spent anodes of a conventional aluminum electrolysis cell, flexible members 18 comprising steel generally have a width of between 0.75 and 1.25 inches, a length of between 10 and 14 inches, and a thickness of from about 0.001 inches to about 0.050 inches, such as between about 0.010 inches to about 0.025 inches.

Figure 5:
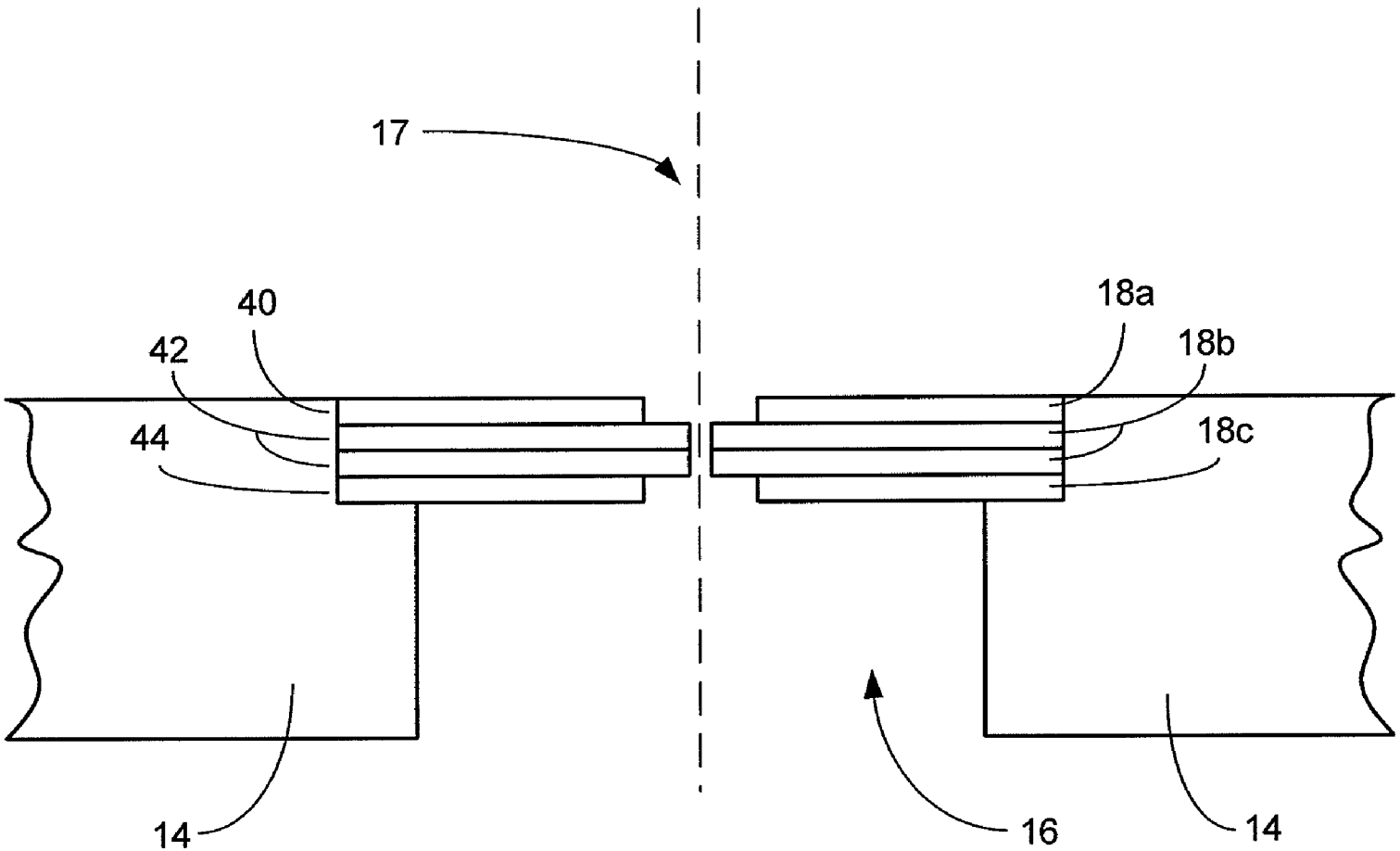
FIG. 5 is a cross-sectional schematic view of another embodiment of an electrode container.

The cover 10 may include a single layer of flexible members 18, as illustrated in FIGS. 1 and 2, or the cover 10 may include a plurality of layers, each layer including at least some flexible members 18. For example, and with reference to FIG. 5, a top layer 40 (e.g., a first layer) of flexible members 18*a*, may be disposed above a middle layer 42 of flexible members 18*b* (e.g., a second or third layer), which may be disposed above a bottom layer 44 of flexible members 18*c*, which may be disposed above, within, or partially within the opening 16. Each of the flexible members 18*a*, 18*b*, and 18*c* of the top, middle and bottom layers 40, 42, 44 are interconnected to the top 14 (e.g., via welding) and extend from the perimeter of the opening 16 toward the center axis 17 of the opening 16.

In one embodiment, the flexible members 18*c* of the bottom layer 44 may have a length that is adapted to receive the anode rod 82 of the spent anode 80, while the flexible members 18*b* of the middle layer 42 may have a length that is adapted to more restrictively engage the anode rod 82 of the spent anode 80 relative to the flexible members 18*c* of the bottom layer 44. Hence, as the cover 10 receives the spent anode 80, the anode rod 82 will be received by the flexible members 18*c* of the bottom layer 44. The flexible members 18*c* of the bottom layer 44 may thus at least partially flex the flexible members 18*b* of the middle layer 42, thereby assisting in receipt of the anode rod by the flexible members 18*b* of the middle layer 42. In this embodiment, the flexible members 18*c* of the bottom layer 44 generally comprise a shorter length than the flexible members 18*b* of the middle layer 42, and the flexible members 18*c* of the bottom later 44 may be thicker than the flexible members 18*b* of the middle layer 42.

In a related embodiment, the flexible members 18*a* of the top layer 40 may have a length that is adapted to facilitate separation of the anode rod from the cover 10. In this regard, the flexible members 18*a* of the top layer 40 may have a length that is shorter than the length of the flexible members 18*b* of the middle layer 42. In one embodiment, the length of the flexible members 18*a* of the top layer 40 is substantially coincidental to, or even the same as, the length of the flexible members 18*c* of the bottom layer 44.

Any number of layers may be utilized in accordance with the present invention, and any number of flexible members 18 having any number of widths, lengths and thicknesses may be employed in one or more of such layers.

Figure 6:
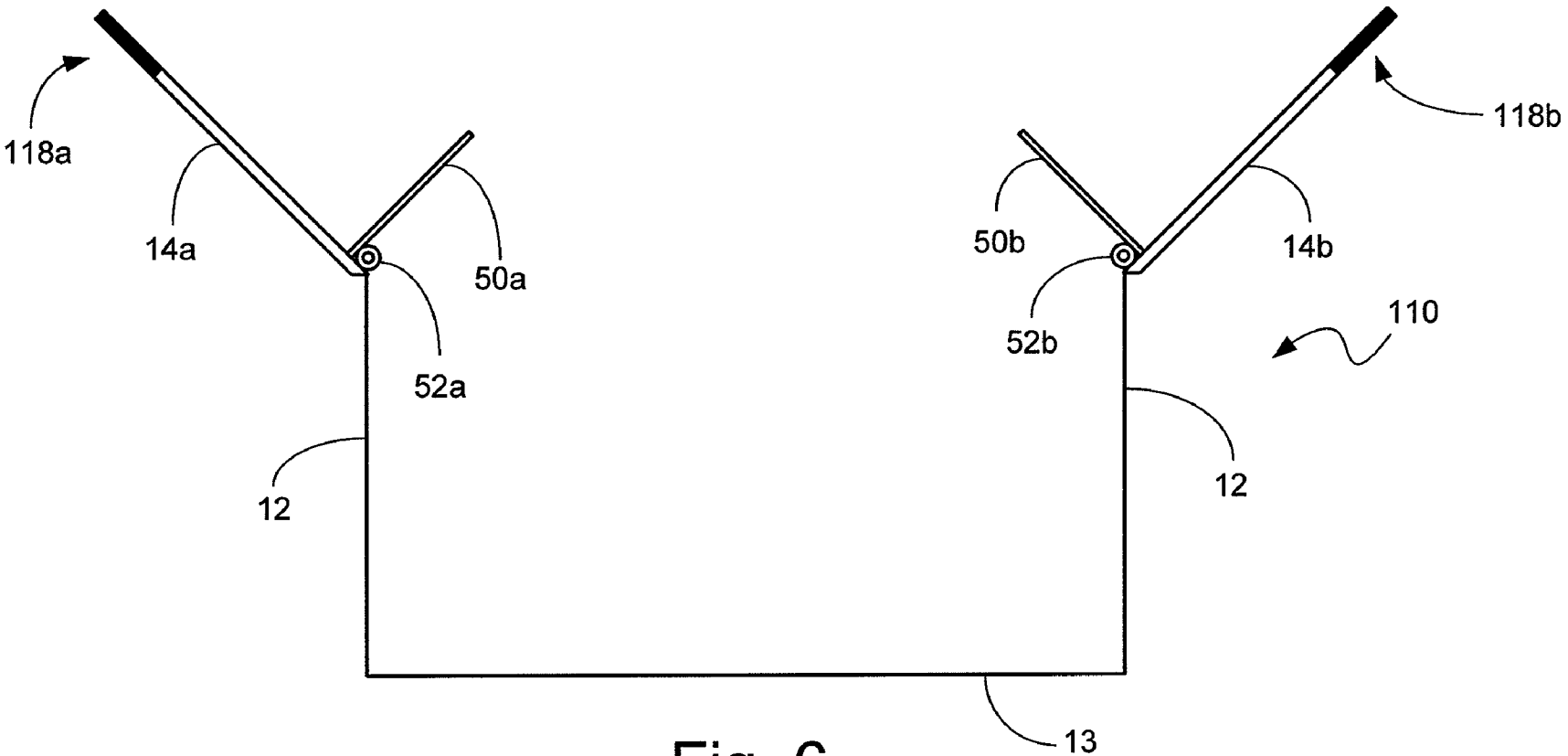
FIG. 6 is a cross-sectional schematic view of another embodiment of an electrode container.
Figure 7A:
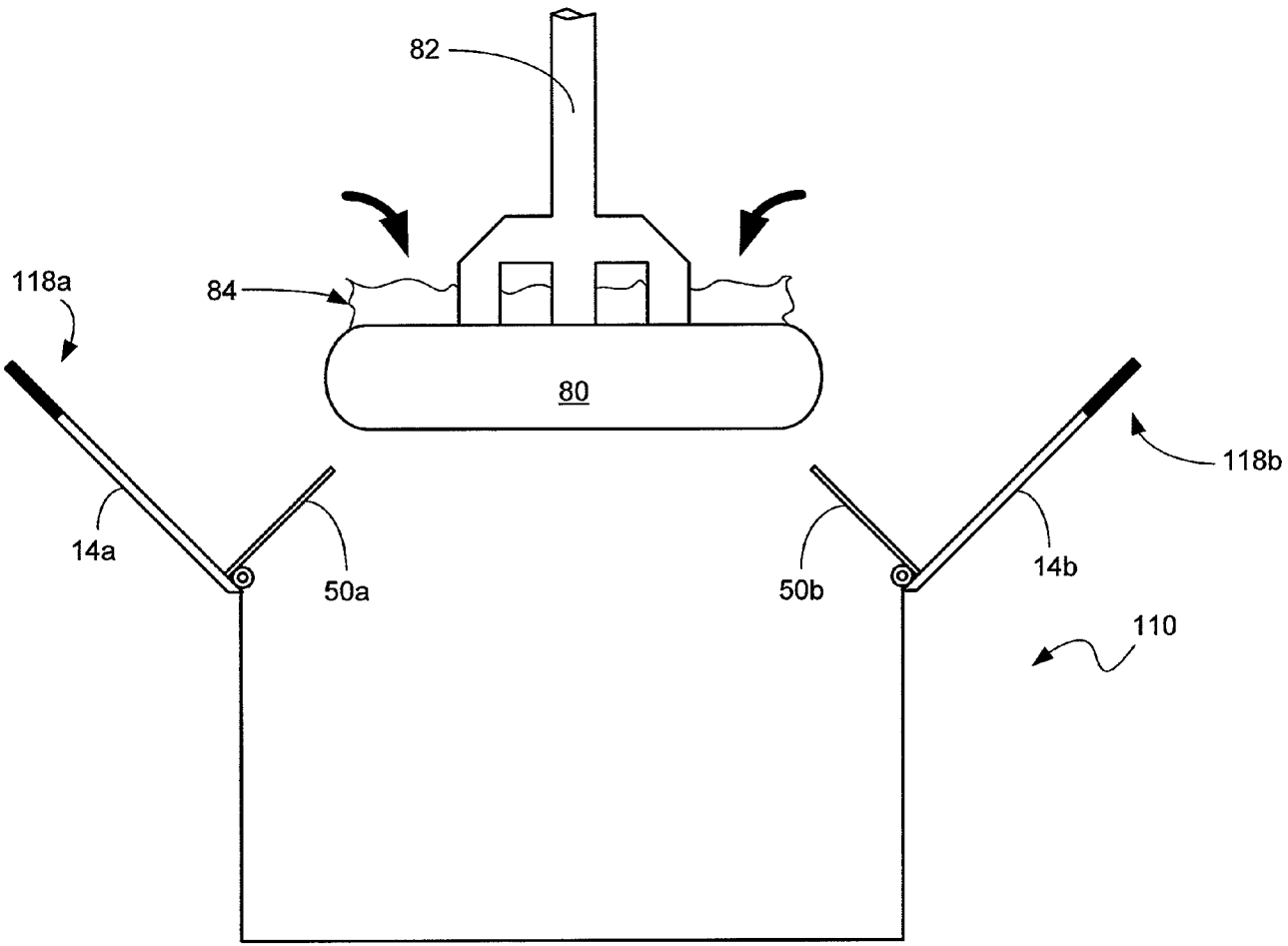
FIGS. 7*a*-7*c* are schematic views of one embodiment of a method for inserting an electrode into the container of FIG. 6.
Figure 7B:
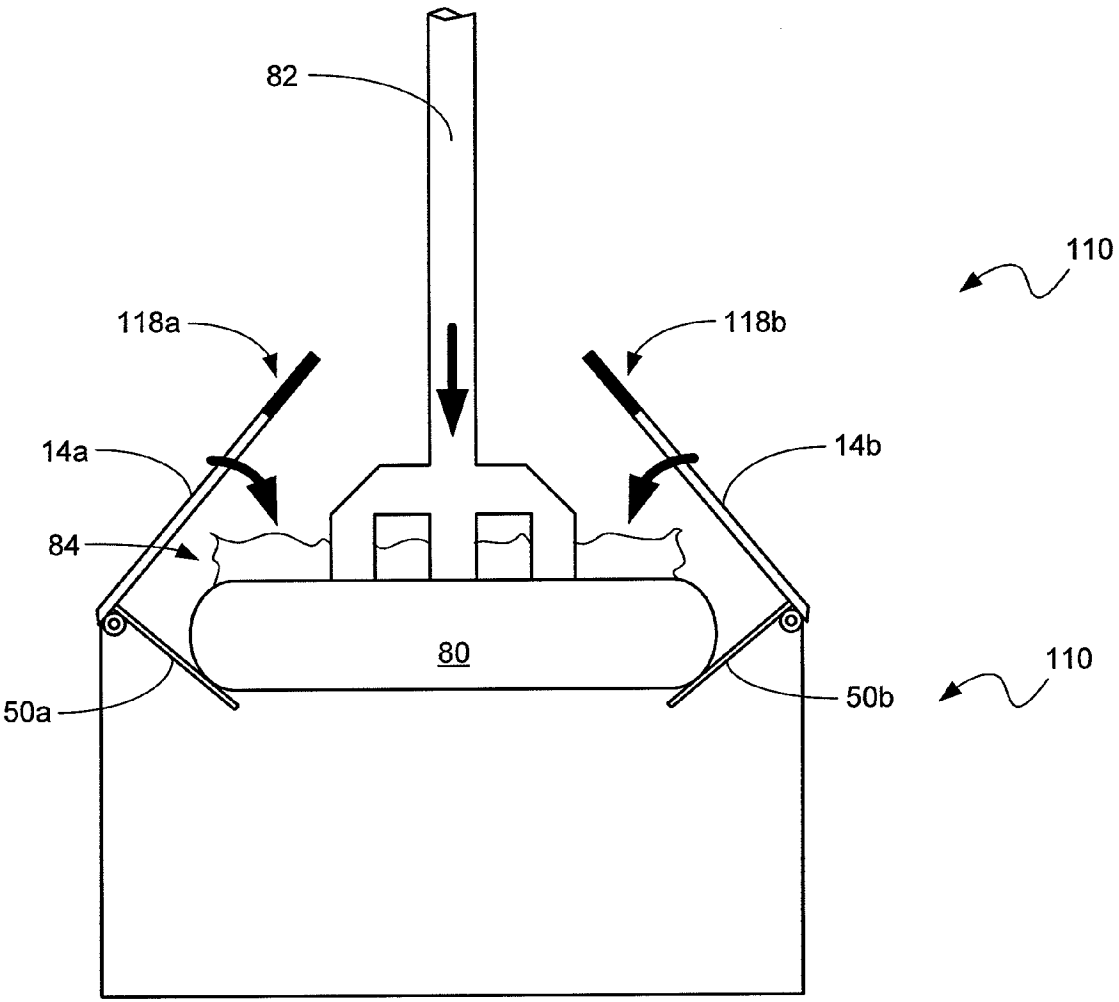
Figure 7C:
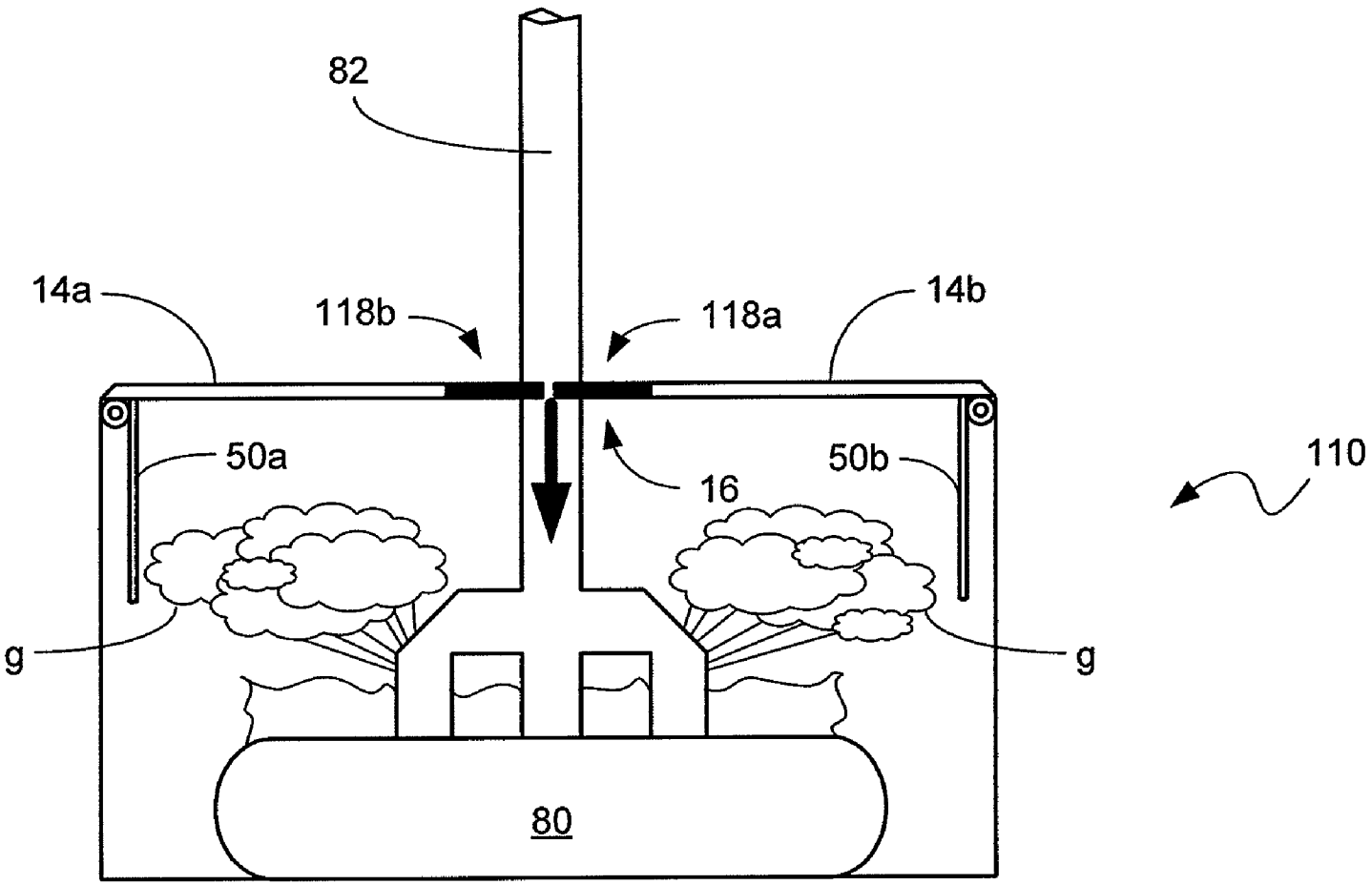

The spent anode cover 10, illustrated above, is generally placed on top of the spent anode 80 after the spent anode 80 has been placed on a platform P. In other embodiments, a spent anode container may include features that facilitate insertion of the spent anode 80 directly into the container. For example, and with reference to FIGS. 6, 7*a*-7*c*, a container 110 may include sides 12, a bottom 13 and a top, the top having a first flap 14*a* and a second flap 14*b*. The first flap 14*a* may be interconnected to one portion of the sides 12 via a first hinge 52*a*, and the second flap may be interconnected to another portion of the sides 12 via a second hinge 52*b*. Thus, the first and second flaps 14*a*, 14*b*, may be moved relative to the insertion and removal of a spent anode 80 relative to the container 110. For example, the first and second flaps 14*a*, 14*b*, may be in a first, open position to facilitate receipt of a spent anode, as illustrated in FIGS. 6 and 7*a*. Similarly, the first and second flaps may be in a second, closed position once a spent anode has been received, as illustrated in FIG. 7*c*. In this second, closed position, the flaps 14*a*, 14*b*, in conjunction with the flexible members 118*a*, 118*b* attached thereto, may restrict gaseous emissions (g) of the spent anode 80 from exiting the container 110 (e.g., as illustrated in FIG. 7*c*). In particular, flexible members 118*a*, 118*b*, may define an opening 16 adapted to surround the rod 82 of the spent anode, wherein at least some of the flexible members 118*a*, 118*b* restrictively engage outer surfaces of the rod 82 so as to restrict gaseous emissions (g) from exiting the container 110 via space surrounding/proximal to the rod 82.

To facilitate movement of the flaps 14*a*, 14*b* from the first, open position to the second, closed position, levers 50*a*, 50*b* may be interconnected with the first and second flaps 14*a*, 14*b*. The levers 50*a*, 50*b*, may be oriented such that, when the first and second flaps 14*a*, 14*b* are in the first open position, they are adapted to physically engage a surface of the spent anode 80 (e.g., as illustrated in FIGS. 7*a*-7*b*). As the spent anode 80 is moved downward into the container 110, surfaces of the spent anode 80 will contact the levers 50*a*, 50*b*, which in turn press on the flaps 14*a*, 14*b*, thereby moving the flaps 14*a*, 14*b* from the first, open position, to a partially closed position (e.g., as illustrated in FIG. 7*b*). As the spent anode 80 continues to move downward into the container 110, the levers 50*a*, 50*b* are further pressed into the container. In turn, flaps 14*a*, 14*b* will continue to move closer to the second, closed position, and will eventually reached the second, closed position (e.g. due to gravity or via continued pressing of the levers 50*a*, 50*b*). Thus, closing of the container 110 may be readily facilitated.

Figure 8:
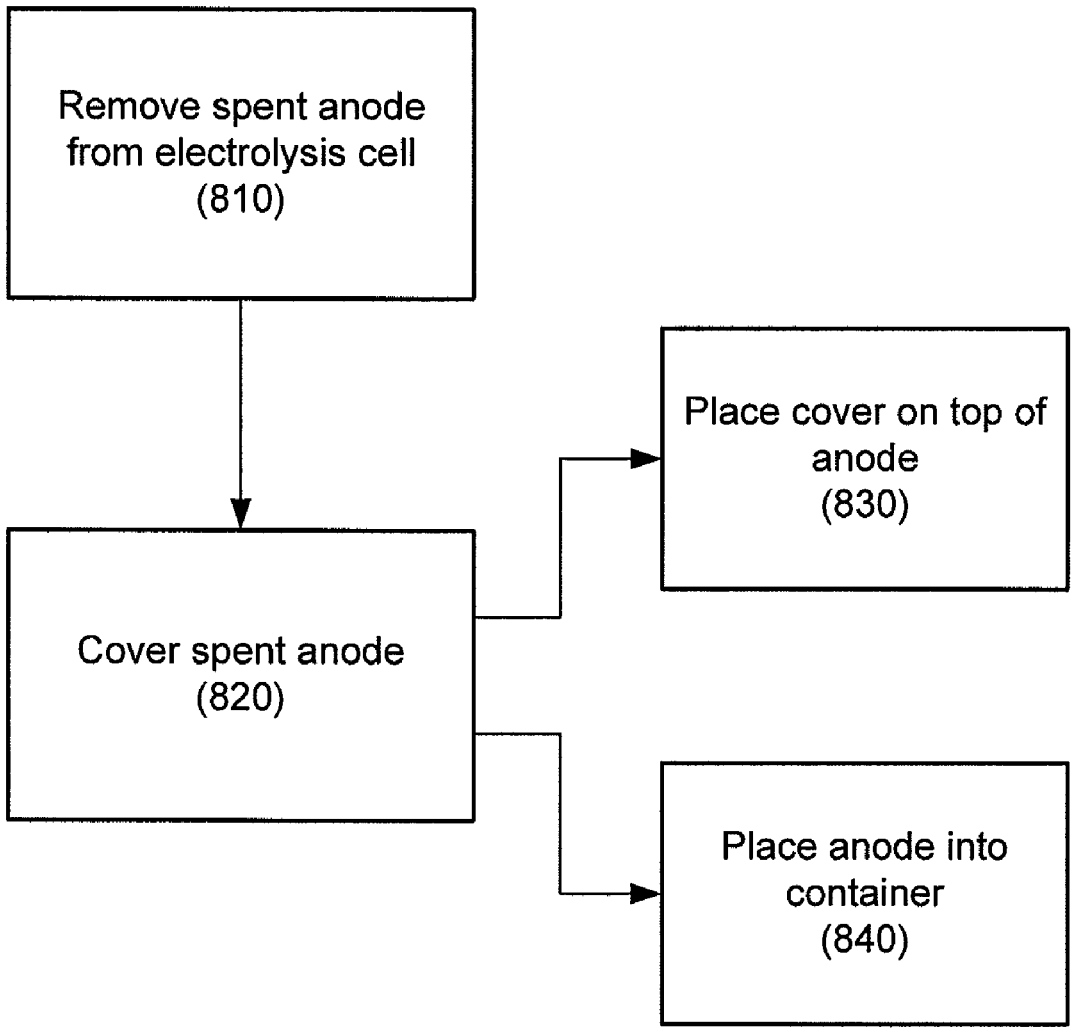
FIG. 8 is a flow chart illustrating embodiments of methods for covering a spent anode.

Methods of covering spent anodes are also provided in the instant disclosure, one embodiment of which is illustrated in FIG. 8. In the illustrated embodiment, the method includes the step of removing a spent anode from an electrolysis cell (810), such as an aluminum electrolysis cell, and covering the spent anode after it has been removed from the electrolysis cell (820). As described above, the spent anode may be covered by either placing a cover on top of the anode (830), or placing the anode into a container (840).

Figure 9:
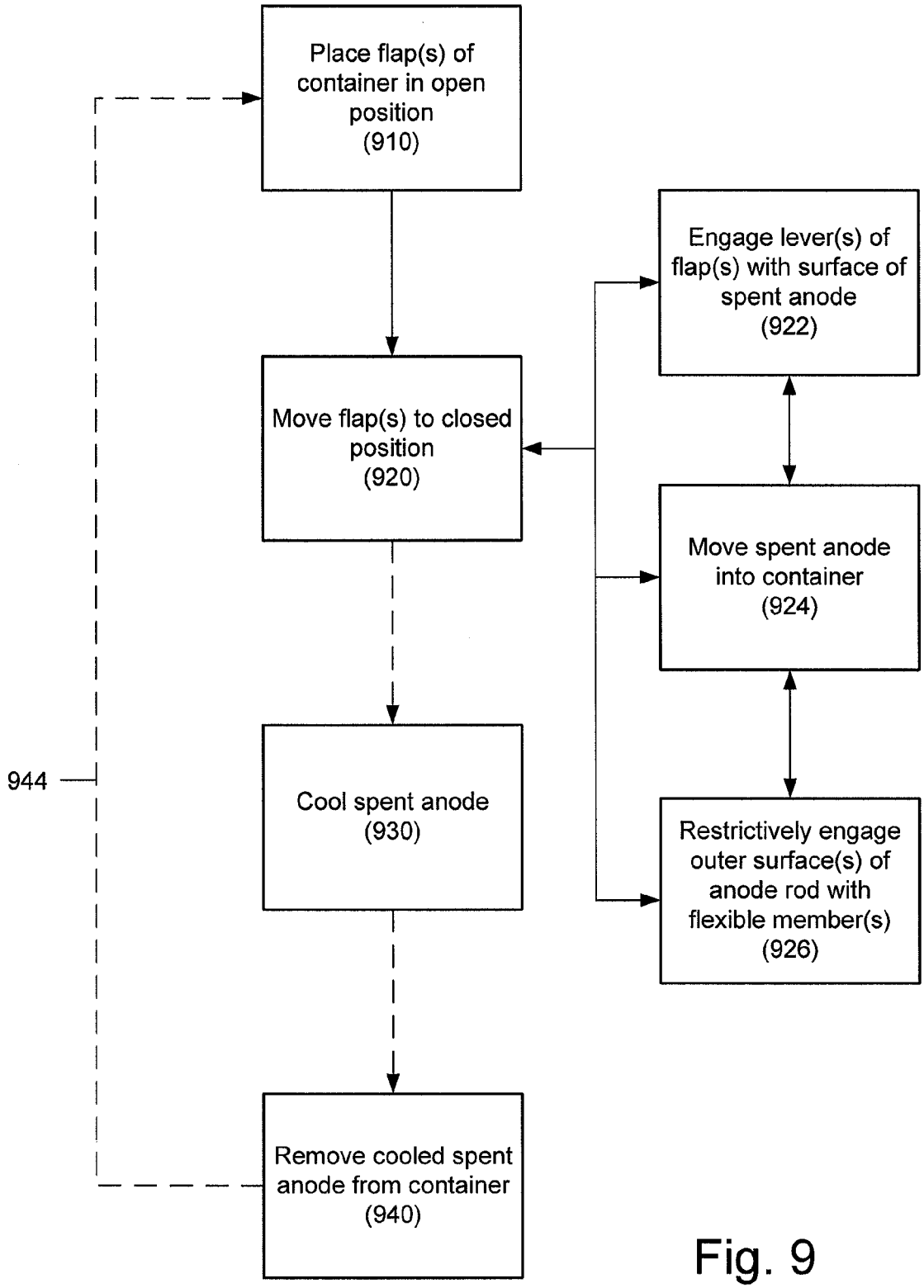
FIG. 9 is a flow chart illustrating one embodiment of a method for covering a spent anode.

With respect to the placing the anode into a container step (840), one embodiment of steps associated therewith is illustrated in FIG. 9. In the illustrated embodiment, the method includes the step of: (i) placing one or more flaps of the container into an open position (910), and (ii) moving the one or more flaps of the container to a closed position (920). The method may also optionally include the steps of cooling the spent anode (930), and removing the cooled spent anode from the container (940). As illustrated by line 944, the step of removing the cooled spent anode from the container (940) may result in moving the flaps of the container from the closed position to the open position, thereby resulting in positioning the flaps of the container to the open position (910). In other words, the placing the flaps step (910) may occur concomitant to the removing the cooled spent anode step (940). Thus, the one or more flaps of the container may be moved from a closed position to an open position, and with little or no human interaction with the flaps or the container.

With respect to the moving the flaps to the closed position step (920), the one or more flaps may be moved to the closed position in response to and/or concomitant with the movement of the spent anode into the container (924). More particularly, as the spent anode is moved into the container, the spent anode may engage one or more levers of the one or more flaps with surface(s) of the spent anode (922). As the spent anode is further moved into the container, and finally into a resting position, the flaps will be moved from the open position to the closed position. Thus, the one or more flaps of the container may be moved from an open position to a closed position, and with little or no human interaction with the flaps or the container. Once the flaps have moved into the closed position, the one or more flexible members of the one or more flaps may restrictively engage outer surface(s) of the anode rod (926). As described above, such restrictive engagement of the anode rod may restrict gaseous emissions from exiting the container.

As described above, the flaps of the container may be opened and closed with little or no human interaction. Thus, the method and container of the instant disclosure may be safer than conventional methods.

While the present invention has been described in terms of use with spent anodes of aluminum electrolysis cells, it will be appreciated that the present invention may be utilized with anodes of other metal electrolysis cells. Furthermore, cathodes may also be used with the instant containers/covers, and thus the term "anode" is not meant to limit the electrode to any particular type. Moreover, while various embodiments of the present invention have been described in detail, it is apparent that modifications and adaptations of those embodiments will occur to those skilled in the art. However, it is to be expressly understood that such modifications and adaptations are within the spirit and scope of the present invention.

What is claimed is:

1. An apparatus, comprising:

a spent electrode container comprising sides and a top, the top comprising an opening adapted to receive a rod of an electrode that has been removed from an aluminum electrolysis cell; and a plurality of flexible members interconnected about the perimeter of the opening, wherein each of the flexible members are permanently fixed to the perimeter of the opening, wherein at least some of the plurality of flexible members overlap with one another, wherein each flexible member extends from the perimeter of the opening towards the center axis of the opening;

further wherein, via the permanent fix and overlap, the plurality of flexible members are adapted to flex and restrictively engage the anode rod as it passes through the central axis of the opening.

2. The apparatus of claim 1, wherein the plurality of flexible members comprise blued steel.

3. The apparatus of claim 1, wherein the opening is of an elliptical shape.

4. The apparatus of claim 3, wherein the opening is of a cylindrical shape.

5. The apparatus of claim 1, wherein each of the plurality of flexible members comprises a width, wherein the width is sufficient to resist breaking from physical engagement with the rod.

6. The apparatus of claim 1, wherein the plurality of flexible members comprise a first layer of members and a second layer of members, wherein the first layer of members comprises a first length, and wherein the second layer of members comprises a second length, wherein the first length is different than the second length.

7. The apparatus of claim 6, wherein at least some of the members of the first layer comprise a first thickness, wherein at least some of the members of the second layer comprise a second thickness, and wherein the first thickness is greater than the second thickness.

8. The apparatus of claim 7, wherein the first layer of members is located above the second layer of members.

9. The apparatus of claim 6, wherein the second layer of members is located above the first layer of members.

10. The apparatus of claim 1, wherein the plurality of flexible members comprise a width sufficient to facilitate flexing while physically engaged with the rod.

11. The apparatus of claim 1, wherein the plurality of flexible members comprise a width of from about 0.75 inches to about 1.25 inches.

12. The apparatus of claim 1, wherein the opening is of a cylindrical shape, wherein the opening has a diameter of between about 20 inches and 28 inches, and wherein the plurality of flexible members comprise a length of about 10 to about 14 inches.

13. The apparatus of claim 1, wherein the top includes a first flap and a second flap, wherein the sides include a first and a second side, wherein the first flap is interconnected to a first side via a hinge, and wherein the second flap is connected to a second side via a hinge.

14. The apparatus of claim 13, wherein the first flap includes a first set of flexible members, and wherein the second flap includes a second set of flexible members, wherein, when the top is in a closed position, the first set of flexible members and second set of flexible members define the opening that receives the rod of the spent electrode.

15. The apparatus of claim 14, further comprising:

a first lever connected to the first flap; and a second lever connected to the second flap, wherein the first and second levers are adapted to engage a surface of the spent electrode as the spent electrode is inserted into the spent electrode container to facilitate movement of the first and second flaps from an open position to a closed position.

16. The apparatus of claim 15, wherein distal ends of the first and second levers extend toward a center axis of the spent electrode container when the first and second flaps are in an open position, and wherein the distal ends of the first and second levers extend toward the bottom of the spent electrode container when the first and second flaps are in a closed position.

17. An apparatus, comprising:

a spent electrode container comprising sides and a top, the top comprising an opening adapted to receive a rod of an electrode that has been removed from an aluminum electrolysis cell; and a plurality of flexible members interconnected about the perimeter of the opening, wherein at least some of the plurality of flexible members overlap with one another, wherein the plurality of flexible members comprise a first layer of members and a second layer of members, wherein the first layer of members comprises a first length, and wherein the second layer of members comprises a second length, wherein the first length is shorter than the second length.

18. An apparatus, comprising:

a spent electrode container comprising sides and a top, the top comprising an opening adapted to receive a rod of an electrode that has been removed from an aluminum electrolysis cell;

a plurality of flexible members interconnected about the perimeter of the opening, wherein at least some of the plurality of flexible members overlap with one another, wherein the plurality of flexible members comprise a first layer of members and a second layer of members, wherein the first layer of members comprises a first length, and wherein the second layer of members comprises a second length; and a third layer of members having a third length, wherein the third layer of members is located below the second layer of members, and wherein the third length is shorter than the second length.

19. The apparatus of claim 18, wherein the third length is approximately the same length as the first length.

* * * * *